US009897284B2

(12) United States Patent
Yan et al.

(10) Patent No.: US 9,897,284 B2
(45) Date of Patent: Feb. 20, 2018

(54) LED-BASED MR16 REPLACEMENT LAMP

(71) Applicant: LedEngin, Inc., San Jose, CA (US)

(72) Inventors: Xiantao Yan, Palo Alto, CA (US); Wu Jiang, Sunnyvale, CA (US); Zequn Mei, Fremont, CA (US)

(73) Assignee: LedEngin, Inc., San Jose, CA (US)

( * ) Notice: Subject to any disclaimer, the term of this patent is extended or adjusted under 35 U.S.C. 154(b) by 75 days.

(21) Appl. No.: 13/851,063

(22) Filed: Mar. 26, 2013

(65) Prior Publication Data

US 2013/0258654 A1 Oct. 3, 2013

Related U.S. Application Data

(60) Provisional application No. 61/617,029, filed on Mar. 28, 2012.

(51) Int. Cl.
*F21V 7/00* (2006.01)
*F21V 9/10* (2006.01)
(Continued)

(52) U.S. Cl.
CPC ..... *F21V 9/10* (2013.01); *F21V 5/04* (2013.01); *F21V 7/0091* (2013.01); *F21Y 2113/13* (2016.08); *F21Y 2115/10* (2016.08)

(58) Field of Classification Search
CPC ..... F21Y 2101/02; F21Y 2105/001; F21Y 2103/003; F21V 7/0091; F21V 7/041; F21V 9/10; F21V 5/05
(Continued)

(56) References Cited

U.S. PATENT DOCUMENTS 4,698,730 A 10/1987 Sakai et al.
5,742,120 A 4/1998 Lin
(Continued)

FOREIGN PATENT DOCUMENTS

JP H9-321341 12/1997
JP H11-298035 10/1999
(Continued)

OTHER PUBLICATIONS

International Search Report & Written Opinion of PCT Application No. PCT/US2009/060525, dated Dec. 2, 2009, 10 pages total.
(Continued)

*Primary Examiner* — Sean Gramling
*Assistant Examiner* — Gerald J Sufleta, II
(74) *Attorney, Agent, or Firm* — Kilpatrick Townsend & Stockton, LLP

(57) ABSTRACT

An LED-based lamp can be made to have a form factor compatible with fixtures designed for MR16 lamps. Such a lamp can have a housing that provides an external electrical connection. Inside the housing is disposed a single emitter structure having a substrate with multiple light-emitting diodes (LEDs) arranged thereon. Different LEDs produce light of different colors (or color temperatures). For example, at least one LED can produce a warm white light, while at least one other LED produces a cool white light and at least one other LED produces a red light. A total-internal-reflection (TIR) lens is positioned to collect light emitted from the single emitter structure and adapted to mix the light from the LEDs to produce a uniform white light. A diffusive coating is applied to a front face of the TIR lens for further color mixing.

12 Claims, 2 Drawing Sheets

(51) Int. Cl.
*F21V 5/04* (2006.01)
*F21Y 115/10* (2016.01)
*F21Y 113/13* (2016.01)

(58) Field of Classification Search
USPC ..... 362/249.01–249.02
See application file for complete search history.

(56) References Cited

U.S. PATENT DOCUMENTS 5,959,316 A 9/1999 Lowery
6,307,160 B1 10/2001 Mei et al.
6,351,069 B1 2/2002 Lowery et al.
6,495,964 B1 12/2002 Muthu et al.
6,608,332 B2 8/2003 Shimizu et al.
6,610,563 B1 8/2003 Waitl et al.
6,614,179 B1 9/2003 Shimizu et al.
6,642,652 B2 11/2003 Collins, III et al.
6,680,128 B2 1/2004 Mei
6,791,116 B2 9/2004 Takahashi et al.
6,828,170 B2 12/2004 Roberts et al.
6,833,565 B2 12/2004 Su et al.
7,064,353 B2 6/2006 Bhat
7,139,125 B1 11/2006 Mi
7,156,538 B2 1/2007 Han et al.
7,157,744 B2 1/2007 Palmteer et al.
7,168,608 B2 1/2007 Mei
7,199,446 B1 4/2007 Mei et al.
7,264,378 B2 9/2007 Loh
7,465,069 B2 12/2008 Li
7,473,933 B2 1/2009 Yan
7,670,872 B2 3/2010 Yan
7,772,609 B2 8/2010 Yan
8,303,141 B2 11/2012 Jiang
8,384,097 B2 2/2013 Yan
8,430,537 B2 4/2013 Wu
9,360,185 B2 * 6/2016 Demuynck ..... F21V 13/04
2001/0015778 A1 8/2001 Murade et al.
2002/0004251 A1 1/2002 Roberts et al.
2002/0015013 A1 2/2002 Ragle
2002/0079837 A1 6/2002 Okazaki
2002/0163006 A1 11/2002 Yoganandan et al.
2002/0191885 A1 12/2002 Wu et al.
2003/0016899 A1 1/2003 Yan
2003/0081428 A1 * 5/2003 Neta ..... 362/558
2003/0086674 A1 5/2003 Yan et al.
2003/0095399 A1 5/2003 Grenda et al.
2003/0116769 A1 6/2003 Song et al.
2003/0122482 A1 7/2003 Yamanaka et al.
2003/0227249 A1 12/2003 Mueller et al.
2003/0230977 A1 12/2003 Epstein
2004/0004437 A1 1/2004 Shimizu et al.
2004/0036081 A1 2/2004 Okazaki
2004/0051111 A1 3/2004 Ota et al.
2004/0079957 A1 4/2004 Andrews et al.
2004/0084687 A1 5/2004 Hohn et al.
2004/0102061 A1 5/2004 Watanabe
2004/0114393 A1 6/2004 Galli
2004/0126918 A1 7/2004 Kurahashi et al.
2004/0129946 A1 7/2004 Nagai et al.
2004/0150991 A1 8/2004 Ouderkirk et al.
2004/0173810 A1 9/2004 Lin et al.
2004/0188697 A1 9/2004 Brunner et al.
2004/0201025 A1 10/2004 Barnett et al.
2004/0207998 A1 10/2004 Suehiro et al.
2004/0257496 A1 12/2004 Sonoda et al.
2005/0035364 A1 2/2005 Sano et al.
2005/0062140 A1 3/2005 Leung et al.
2005/0093146 A1 5/2005 Sakano
2005/0127281 A1 6/2005 Zheng et al.
2005/0145872 A1 7/2005 Fang et al.
2005/0179376 A1 8/2005 Fung et al.
2005/0199900 A1 9/2005 Lin et al.
2005/0221519 A1 10/2005 Leung et al.
2005/0224829 A1 10/2005 Negley et al.
2005/0224830 A1 10/2005 Blonder et al.
2005/0253242 A1 11/2005 Costello et al.
2005/0270666 A1 12/2005 Loh et al.
2005/0286131 A1 12/2005 Saxena et al.
2006/0012299 A1 1/2006 Suehiro et al.
2006/0063287 A1 3/2006 Andrews
2006/0082296 A1 4/2006 Chua et al.
2006/0082679 A1 4/2006 Chua et al.
2006/0091416 A1 5/2006 Yan
2006/0091788 A1 5/2006 Yan
2006/0097385 A1 5/2006 Negley
2006/0102914 A1 5/2006 Smits
2006/0105484 A1 5/2006 Basin
2006/0105485 A1 5/2006 Basin
2006/0170332 A1 8/2006 Tamaki et al.
2006/0284209 A1 12/2006 Kim et al.
2006/0289050 A1 12/2006 Alley et al.
2007/0023769 A1 2/2007 Nishimoto et al.
2007/0081360 A1 4/2007 Bailey et al.
2007/0090375 A1 4/2007 Kobilke
2007/0152212 A1 7/2007 Cho et al.
2007/0194341 A1 8/2007 Chang et al.
2007/0215893 A1 9/2007 Liao et al.
2007/0223219 A1 9/2007 Medendorp, Jr. et al.
2007/0228390 A1 10/2007 Hattori et al.
2007/0241357 A1 10/2007 Yan
2007/0278512 A1 12/2007 Loh et al.
2008/0012036 A1 1/2008 Loh et al.
2008/0048200 A1 2/2008 Mueller et al.
2008/0308825 A1 12/2008 Chakraborty et al.
2009/0168159 A1 * 7/2009 Roorda et al. ..... 359/387
2010/0091499 A1 4/2010 Jiang et al.
2010/0155755 A1 6/2010 Dong
2010/0259924 A1 10/2010 Dong
2011/0012512 A1 1/2011 Young et al.
2012/0008318 A1 * 1/2012 Ishiwata et al. ..... 362/231
2012/0120649 A1 * 5/2012 Catalano et al. ..... 362/231
2012/0206911 A1 * 8/2012 Pickard ..... F21S 8/026 362/231
2013/0114241 A1 * 5/2013 van de Ven ..... H05B 33/0866 362/84
2013/0135866 A1 * 5/2013 Souvay ..... F21K 9/00 362/249.02
2016/0381749 A1 * 12/2016 Catalano ..... F21S 10/00 315/297

FOREIGN PATENT DOCUMENTS

JP 2000-349346 12/2000
JP 2000-349347 12/2000
JP 2001-057445 2/2001
JP 2001-168398 6/2001
JP 2002-185046 6/2002
JP 2004-031508 1/2004
JP 2004-111937 4/2004
JP 2004-241704 8/2004
JP 2004-253404 9/2004
JP 2004-259958 9/2004
JP 2004-266246 9/2004
JP 2004-274087 9/2004
JP 2004-282004 10/2004

OTHER PUBLICATIONS

Kading, O.W., "Thermal Conduction in Metallized Silicon-Dioxide Layers on Silicon," Applied Physics, Sep. 1994, vol. 65, No. 13, pp. 1629-1631.
"Solvent Soluble Polyimide with High Transparency and High Tg: HOP-400, 500," Hitachi Cable Review, Aug. 2003, No. 22, p. 78.
Yan, Xiantao, "Two Test Specimens for Determining the Interfacial Fracture Toughness in Flip-Chip Assemblies," Jun. 1998, Transactions of the ASME, vol. 120, pp. 150-155.
Yan, Xiantao, "Analysis Based Design Guidelines for Metal Runner and Passivation Layers in IC Packaging," Delphi Automotive Systems, Analytical Engineering Conference, May 2000, pp. 1-4.
Harper, Charles A.; "Electronic Materials and Processes Handbook," 2004; The McGraw-Hill Companies; Third Edition; p. 2.39.

(56) References Cited

OTHER PUBLICATIONS

"LRP-38-The first viable LED lamp that combines the vibrant color of halogen with high efficacy", http://www.creeledlighting.com/lrp-38.htm, 1 page.

* cited by examiner

LED-BASED MR16 REPLACEMENT LAMP

CROSS-REFERENCES TO RELATED APPLICATIONS

The present application claims the benefit under 35 USC § 119(e) of U.S. Provisional Application No. 61/617,029 filed Mar. 28, 2012, the disclosure of which is incorporated herein by reference in its entirety for all purposes.

BACKGROUND

The present disclosure relates generally to lighting devices and in particular to an LED-based lamp having a form factor compatible with standard MR16 lamps.

One popular type of halogen lamp is the multifaceted reflector ("MR") type. MR lamps are generally conical in shape, with a halogen bulb placed in front of a multifaceted reflector that directs the light toward a front face. The facets of the reflector provide a pleasingly soft edge to the emergent light beam. "MR16" refers to an MR-type lamp with a 2-inch diameter at the front face. Numerous lighting systems and fixtures have been designed to accommodate MR16 lamps.

It is known that the efficiency of light-emitting diodes (LEDs), measured, e.g., in lumens/watt, is generally higher than that of halogen bulbs. Therefore, it would be desirable to provide an LED-based lamp having a form factor compatible with fixtures designed for MR16 lamps.

BRIEF SUMMARY

Embodiments of the present invention provide LED-based lamps that can be made to have a form factor compatible with fixtures designed for MR16 lamps. Such a lamp can have a housing that provides an external electrical connection. Inside the housing is disposed a single emitter structure having a substrate with multiple light-emitting diodes (LEDs) arranged thereon. Different LEDs produce light of different colors (or color temperatures). For example, at least one LED can produce a warm white light, while at least one other LED produces a cool white light and at least one other LED produces a red light. A total-internal-reflection (TIR) lens is positioned to collect light emitted from the single emitter structure and adapted to mix the light from the LEDs to produce a uniform white light. A diffusive coating is applied to a front face of the TIR lens for further color mixing.

The following detailed description together with the accompanying drawings will provide a better understanding of the nature and advantages of the present invention.

DETAILED DESCRIPTION

Embodiments of the present invention provide LED-based lamps that can be made to have a form factor compatible with fixtures designed for MR16 lamps. Such a lamp can have a housing that provides an external electrical connection. Inside the housing is disposed a single emitter structure having a substrate with multiple light-emitting diodes (LEDs) arranged thereon. Different LEDs produce light of different colors (or color temperatures). For example, at least one LED can produce a warm white light, while at least one other LED produces a cool white light and at least one other LED produces a red light. A total-internal-reflection (TIR) lens is positioned to collect light emitted from the single emitter structure and adapted to mix the light from the LEDs to produce a uniform white light. A diffusive coating is applied to a front face of the TIR lens for further color mixing.

Figure 1:
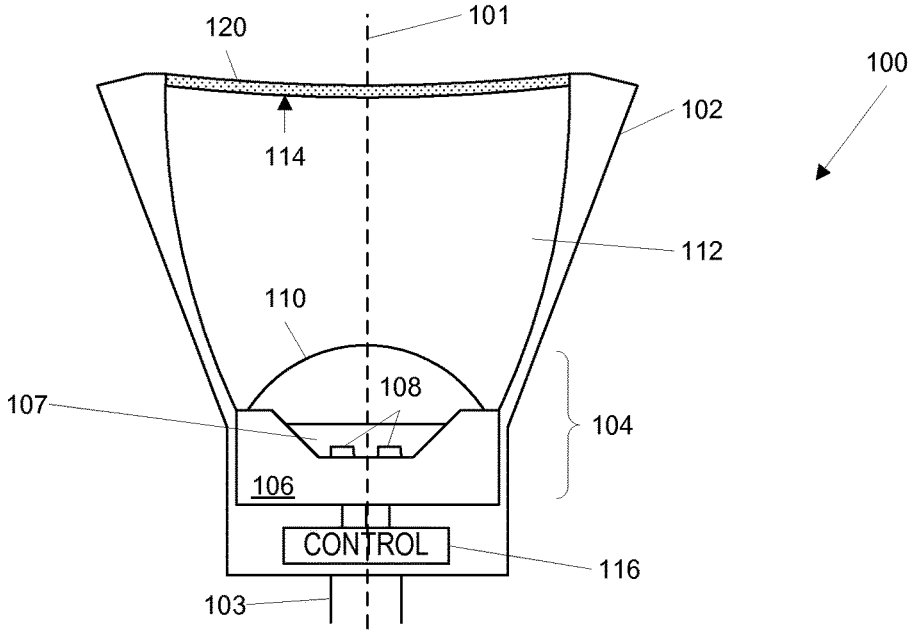
FIG. 1 is a simplified cross-sectional side view of an LED-based lamp according to an embodiment of the present invention.

FIG. 1 is a simplified cross-sectional side view of an LED-based lamp 100 according to an embodiment of the present invention. Lamp 100, which is cylindrically symmetric about an axis 101, has a housing 102, which can be made of aluminum, other metals, plastic, and/or other suitable material. Housing 102 holds the various components of lamp 100 together and can provide a convenient structure for a user to grip lamp 100 during installation or removal from a light fixture. The exterior of housing 102 can include mechanical and/or electrical fittings 103 to secure lamp 100 into a light fixture and/or to provide electrical power for producing light. These fittings can be compatible with existing MR16 lighting systems. In some embodiments, housing 102 may include fins or other structures to facilitate dissipation of heat generated during operation of lamp 100. The exterior shape of housing 102 can be made to conform to a standard lamp form factor, such as MR16.

Within housing 102 is an emitter package 104. Package 104 includes a substrate 106 in which is formed a recess 107. Substrate 106 can be a multilayer structure with ceramic and metal layers. Examples are described in U.S. Patent Application Pub. No. 2010/0259930, the disclosure of which is incorporated herein by reference. Other substrates can also be used.

LEDs 108 are mounted on substrate 106 within recess 107. In some embodiments, the top surface of recess 107 is patterned with a number of metal pads, each accommodating a single LED 108. Each LED 108 can be a separate semiconductor die structure fabricated to produce light of a particular color in response to electrical current. In some embodiments, LEDs 108 can be covered with a material containing a color-shifting phosphor so that LED 108 produces light of a desired color. For example, a blue-emitting LED die can be covered with a material containing a yellow phosphor; the emerging mixture of blue and yellow light is perceived as white light having a particular color temperature. As described below, in some embodiments different ones of LEDs 108 produce light of different colors; LEDs 108 need not be identical.

Lamp 100 also includes a primary lens 110, which can be made of glass, plastic or other optically transparent material, that is positioned to direct light emitted from LEDs 108 into secondary optics 112. Secondary optics 112 advantageously include a total-internal-reflection (TIR) lens that also provides mixing of the colors of light emitted from LEDs 108 such that the light beam exiting through front face 114 has a uniform color. Examples of suitable lenses are described in U.S. Patent Application Pub. No. 2010/0091491; other color-mixing lens designs may also be used.

Lamp 100 also includes a diffusive coating 120 on front face 114 of lens 112. Coating 120 provides further color mixing of the light exiting secondary optics 112 without requiring additional space, a significant consideration when designing a lamp with a compact form factor such as MR16. Various coatings 120 can be used. In some embodiments, coating 120 can be a holographic diffuser film, such as a light-shaping diffuser film made by Luminit Co. of Torrance, Calif. (website at www.lumintco.com). In these films, the diffusive coating is provided as a diffusive material disposed in a desired pattern on an optically transparent substrate film (e.g., acrylic, polyester, polycarbonate, glass or fused silica). The film is easily applied to front face 114. Other types of coatings can also be applied; for example, diffusive material can be applied directly to front face 114. Coating can improve color mixing without requiring additional space, a significant consideration with a small form factor such as MR16.

In some embodiments, lamp 100 includes a control circuit 116 that controls the power provided from an external power source (not shown) to LEDs 108. In some embodiments, control circuit 116 allows different amounts of power to be supplied to different LEDs 108, allowing for tuning of the color as described below.

Figure 2:
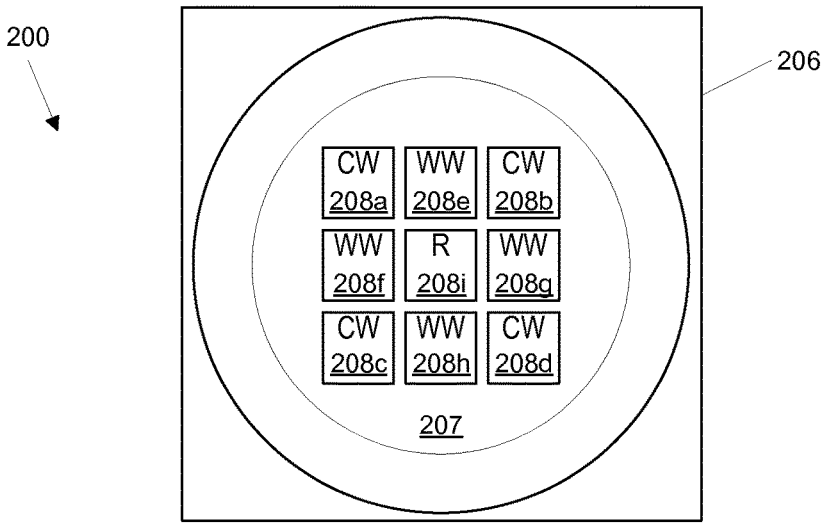
FIG. 2 is a simplified top view of a nine-die LED package that can be used in the lamp of FIG. 1 according to an embodiment of the present invention.

FIG. 2 is a simplified top view of a nine-die emitter 200 implementing emitter package 104 of FIG. 1 according to an embodiment of the present invention. In this embodiment, substrate 206 includes a recess 207 in which nine LEDs 208*a-i* are disposed as shown. LEDs 208*a-d* are cool white (CW) LEDs; LEDs 208*e-h* are warm white LEDs, and LED 208*i* is a red (R) LED. "Cool" white and "warm" white, as used herein, refer to the color temperature of the light produced. Cool white, for example, can correspond to a color temperature above, e.g., about 4000 K, while warm white can correspond to a color temperature below, e.g., about 3000 K. It is desirable that cool white LEDs 208*a-d* have a color temperature cooler than a target color temperature for lamp 100 while warm white LEDs 208*e-h* have a color temperature warmer than the target color temperature. When light from cool white LEDs 208*a-d* and warm white LEDs 208*e-h* is mixed by mixing lens 112, an intermediate color temperature can be achieved. Red LED 208*i* provides additional warming. Examples of techniques for selecting LEDs for an emitter to provide a desired output color are described, e.g., in U.S. patent application Ser. No. 13/240,796, the disclosure of which is incorporated herein by reference.

In some embodiments, LEDs 208 are advantageously provided with electrical connections such that different groups of the LEDs are independently addressable, i.e., different currents can be supplied to different groups of LEDs. For example, a first group can include cool white LEDs 208*a-d*, a second group can include warm white LEDs 208*e-h*, and a third group can include red LED 208*i*. (A "group" of one LED is permitted.) These electrical connections can be implemented, e.g., using traces disposed on the surface of substrate 206 and/or between electrically insulating layers of substrate 206.

Where the different LED groups are interpedently addressable, package 200 provides an emitter that can be tuned to produce light of a desired color (e.g., color temperature) by adjusting the relative current delivered to different groups of LEDs 208, e.g., using control circuit 116. Techniques for tuning an emitter have been described, e.g., in U.S. patent application Ser. No. 13/106,808 and U.S. patent application Ser. No. 13/106,810, the disclosures of which are incorporated herein by reference.

In other embodiments, the color temperature of the light produced by the lamp can be controlled by selecting cool white LEDs 208*a-d* and warm white LEDs 208*e-h* such that the desired color (e.g., color temperature) is achieved when equal currents are supplied to all LEDs 208 (including red LED 208*i*). Selection of LEDs for a given substrate can be done by testing individual LED dice prior to substrate assembly to determine the color temperature of light produced and binning the LED dice according to color temperature. By selecting the warm white and cool white LEDs for a substrate from appropriately paired warm-white and cool-white bins, a desired color temperature for the lamp can be achieved when all LEDs are supplied with the same current. Accordingly, color tuning by adjusting the relative current supplied to different groups of LEDs is not required.

In the embodiment of FIG. 2, the LEDs are arranged to provide a roughly uniform circular distribution of cool white and warm white LEDs. That is, the cool white and warm white LEDs are intermixed and arranged such that warm and cool light are produced in approximately equal intensities across different parts of the emitter substrate. This allows for optimal color mixing using secondary optics such as TIR lens 112 of FIG. 1, to produce a uniformly white light from LEDs that are not uniform in color.

Figure 3:
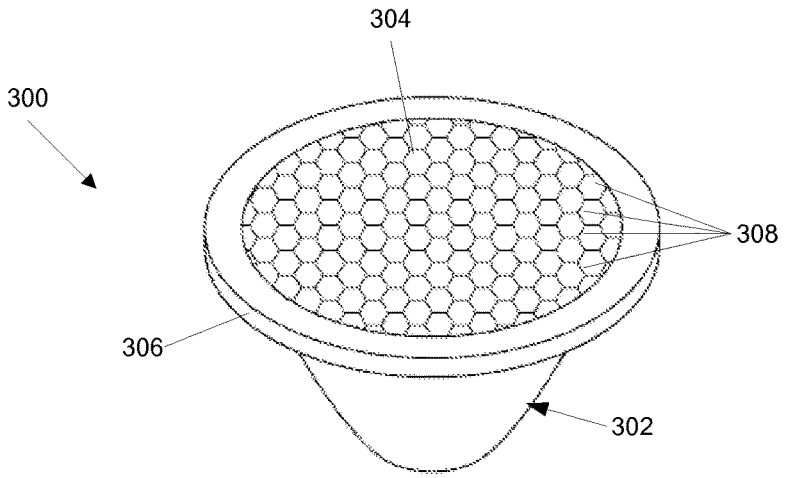
FIG. 3 is a perspective view of a TIR lens that can be used in the lamp of FIG. 1 according to an embodiment of the present invention.
Figure 4:
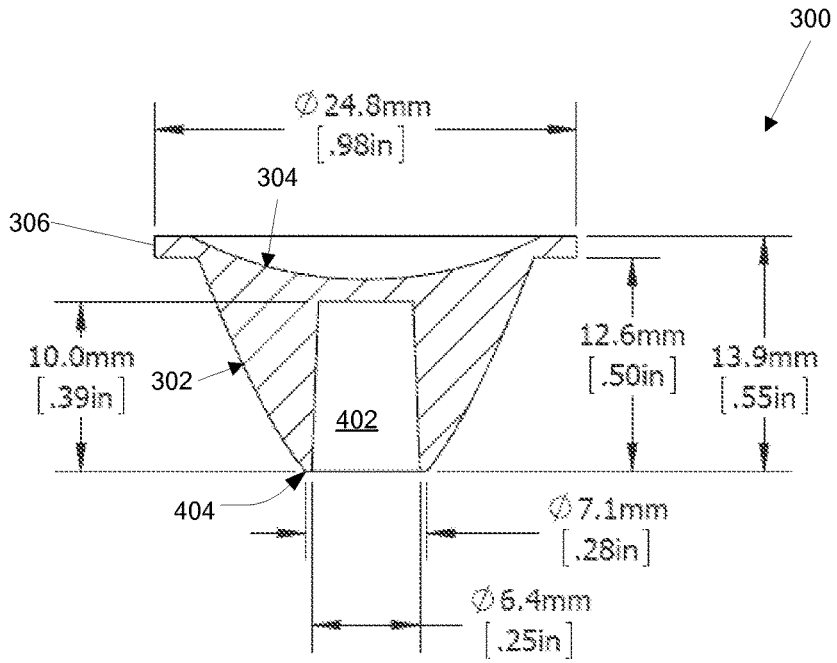
FIG. 4 is a cross-section side view of the TIR lens of FIG. 3.

FIG. 3 is a perspective view of a TIR lens 300 that can be used in secondary optics 112 of lamp 100 of FIG. 1 according to an embodiment of the present invention, and FIG. 4 is a cross-section side view of TIR lens 300 showing illustrative dimensions, all of which can be varied as desired. TIR lens 300 can be made of an optically transparent material such as glass or plastic (e.g., polymethylmethacrylate (PMMA)) and can be manufactured, e.g., using conventional processes such as molding processes in the case of a plastic lens. TIR lens 300 has a smooth side wall 302, a front (or top) face 304 and a flange 306. As shown in FIG. 4, a central cavity 402 is created inside lens 300, extending partway to front face 304. Cavity 402 is open at the rear (or bottom), and primary lens 110 of package 104 (FIG. 1) can extend into cavity 402. Bottom (or rear) edge 404 of lens 300 can be sized and shaped to contact the edges of package 104 surrounding primary lens 110, as shown schematically in FIG. 1. This provides alignment of the package with respect to the TIR lens.

As shown in FIG. 3, front face 304 of lens 300 is patterned with hexagonal microlenses 308. Microlenses 308 provide beam shaping, and the pattern can be chosen to create a desired beam width. In FIG. 4, front face 304 is shown as having a concave shape. Each microlens 308, however, has a convex curvature, providing small local excursions from the generally concave contour of front face 304.

As noted above, a diffusive coating, such as a holographic diffuser film, can be applied over front face 304. This coating can follow the general shape of face 304. The diffusive coating enhances color mixing while allowing lens 300 to remain small. This facilitates the use of color mixing lenses in lamps with small form factors.

Side wall 302 can be shaped to optimize total internal reflection for an emitter disposed at a position determined by bottom edge 404 and cavity 402. In some embodiments, side wall 302 of lens 300 can be coated with a reflective material, or a reflective housing can be placed around sidewall 302 to reduce light loss through side wall 302.

Flange 306 extends peripherally from top face 304 and can be used to secure lens 300 in a housing such as housing 102 of FIG. 1. In some embodiments, flange 306 does not affect the optical properties of lens 300; the size and shape of flange 306 can be modified based on mechanical design considerations (e.g., retention of the lens within the housing of an assembled lamp).

The beam angle produced by lens 300 can controlled by suitable selection of various design parameters for the lens, in particular the size and shape of microlenses 308. Examples of the effects of changing a microlens pattern and other lens design parameters are described, e.g., in U.S. Pat. No. 8,075,165, the disclosure of which is incorporated herein by reference. The particular configuration shown in FIGS. 3 and 4 results in light with a beam angle of about 35-40 degrees, but other configurations can provide different beam angles.

In some embodiments, nine-die emitter 200 of FIG. 2 and lens 300 can be placed within an exterior lamp housing (shown schematically as housing 102 in FIG. 1) whose outer shape conforms to a standard MR16 lamp form factor. This housing, which can be made primarily or entirely of metal, can be a solid structure, a finned structure, a webbed structure or the like. Housing 102 can incorporate various mechanical retention features (e.g., slots, flanges, through-holes for screws or other fasteners, or the like) to secure emitter 200 and lens 300 in the desired arrangement. In some embodiments, housing 102 is also designed to facilitate dissipation of heat produced by package 200 during lamp operation, and metals or other materials with good heat transfer properties can be used.

An LED-based MR16 replacement lamp as described herein can provide high performance and improved energy efficiency as compared to existing halogen lamps. For example, a 12-watt lamp constructed as described herein can generate approximately 600 lumens with a color temperature of about 2700-2800 K. In a floodlight configuration (beam angle of 35-40 degrees), center beam candle power (CBCP) of approximately 2000 candelas is obtained. These numbers compare favorably with existing halogen MR16 lamps operating at higher power (e.g., 35-50 watts).

While the invention has been described with respect to specific embodiments, one skilled in the art will recognize that numerous modifications are possible. For example, the emitter can include a different number or arrangement of LEDs. The LEDs can be arranged in various ways; in some embodiments, rotationally symmetric arrangements (e.g., as shown in FIG. 2) are preferred for optimum color mixing. Use of a single emitter with multiple LEDs in combination with a color-mixing lens and a diffusive coating provides uniform color of a desired temperature with a compact form-factor.

The shape of the TIR color-mixing lens can also be varied, subject to constraints based on the overall form factor of the lamp and the need for electrical, mechanical, and heat-dissipation structures. In general, the optimum lens shape depends in part on the characteristics of the emitter, and if the emitter is changed, the lens design can be reoptimized taking into account the desired color mixing and light output efficiency. The lens can be constructed of any material with suitable optical properties. In some embodiments, the outer side surface of the lens can be coated with a reflective material to further increase light output.

The front face of the secondary lens can be coated with a diffusive material to further improve the color uniformity of the light. A variety of materials can be used, including film coatings, spray-on materials, curable materials, or other materials as desired.

The housing holds the various components together and provides electrical and mechanical fittings usable to install the lamp in a light fixture. These fittings can be adapted to particular standards. In some embodiments, the housing can include a reflective holder surrounding the sides of the TIR color-mixing lens. The housing can also incorporate heat-dissipation structures (e.g., fins or webs of metal or other material with high thermal conductivity).

While specific reference is made herein to MR16 lamps to define a form factor, it is to be understood that similar principles can be applied to design compact LED-based lamps with other form factors.

Thus, although the invention has been described with respect to specific embodiments, it will be appreciated that the invention is intended to cover all modifications and equivalents within the scope of the following claims.

What is claimed is:

1. A lamp comprising:

a housing providing an external electrical connection, wherein the housing incorporates a heat-dissipating structure, wherein the housing has an outer shape conforming to a form factor of an MR16 lamp;

a single emitter structure disposed within the housing, the single emitter structure having:

a substrate having a recess;

a plurality of light-emitting diodes (LEDs) arranged within the recess, wherein each LED is a separate semiconductor die mounted on the substrate, wherein different ones of the plurality of LEDs produce light of different colors, and wherein the plurality of LEDs includes at least one LED that produces a warm white light, at least one LED that produces a cool white light, and at least one LED that produces a red light;

wherein the substrate includes electrical connection traces such that the LEDs are connected to form a plurality of independently addressable groups; and a primary lens disposed over the recess;

a total-internal-reflection (TIR) lens positioned to collect light emitted from the single emitter structure and adapted to mix the light from the plurality of LEDs to produce a uniform white light, wherein the TIR lens has:

a concave front surface having a plurality of hexagonal convex microlenses thereon; and a central cavity extending along the optical axis from a rear surface to a point more than halfway to the concave front surface, wherein the primary lens of the single emitter structure extends partway into the central cavity;

a diffusive coating applied to a front face of the TIR lens; and a control circuit disposed within the housing and configured to supply different amounts of power to different ones of the independently addressable groups of the LEDs to provide a tunable color of light.

2. The lamp of claim 1 wherein the housing has an outer shape conforming to a form factor of an MR16 lamp.

3. The lamp of claim 1 wherein the housing incorporates a heat-dissipating structure.

4. The lamp of claim 1 wherein the plurality of LEDs consists of nine LEDs arranged in a 3×3 grid, with the red-light-producing LED placed in a center position of the 3×3 grid and four cool-white LEDs and four warm-white LEDs placed in alternating positions surrounding the red-light-producing LED in the 3×3 grid.

5. The lamp of claim 4 wherein the four cool-white LEDs and the four warm-white LEDs are selected such that the light output by the lamp has a desired color temperature when an equal current is supplied to all of the plurality of LEDs.

6. The lamp of claim 1 wherein a sidewall of the TIR lens is coated with a reflective material.

7. The lamp of claim 1 wherein the diffusive coating comprises a holographic film.

8. The lamp of claim 1 wherein the lamp produces light with a beam angle between about 35 and about 40 degrees.

9. The lamp of claim 8 wherein the lamp produces light with a center beam candle power of not less than 2000 candelas.

10. The lamp of claim 1 wherein the lamp produces a light output of at least 600 lumens when operated at a nominal power consumption of 12 watts.

11. The lamp of claim 10 wherein the lamp produces light having a color temperature of about 2700-2800 K.

12. The lamp of claim 1 wherein the LEDs are electrically connected to provide a first group consisting of the at least one LED that produces cool white light, a second group consisting of the at least one LED that produces warm white light, and a third group consisting of the at least one LED that produces red light.

* * * * *